United States Patent [19]

Sugiyama

[11] Patent Number: 5,031,880

[45] Date of Patent: Jul. 16, 1991

[54] ROPE TRACTION DEVICE

[75] Inventor: Yutaka Sugiyama, Tokyo, Japan

[73] Assignee: Nihon Biso Kabushiki Kaisha, Tokyo, Japan

[21] Appl. No.: 468,614

[22] Filed: Jan. 23, 1990

Related U.S. Application Data

[62] Division of Ser. No. 373,904, Jun. 29, 1989.

[30] Foreign Application Priority Data

Dec. 9, 1988 [JP] Japan ..... 63-311447

[51] Int. Cl.[5] ..... B66D 5/24

[52] U.S. Cl. ..... 254/375; 188/72.300; 188/170; 188/171; 188/173

[58] Field of Search ..... 254/375, 376; 464/160; 188/171, 173, 72.3, 170

[56] References Cited

U.S. PATENT DOCUMENTS

| | | | |
|---|---|---|---|
| 1,408,209 | 2/1922 | Kleber | 254/375 X |
| 1,613,895 | 1/1927 | Kitchell | 254/372 X |
| 2,181,359 | 11/1939 | Barrett | 254/375 X |
| 2,552,928 | 5/1951 | Benson | 254/376 X |
| 3,426,979 | 2/1969 | Gigante | 254/376 X |
| 3,784,165 | 1/1974 | Bruitt | 254/375 X |
| 4,834,341 | 5/1989 | Baum | 254/375 |

*Primary Examiner*—Katherine Matecki

*Attorney, Agent, or Firm*—Hedman, Gibson, Costigan & Hoare

[57] ABSTRACT

A rope traction device used as a winding instrument for a moving scaffold and other construction, loading and unloading and conveying machines includes a sheave which is rotated by a motor through a speed reduction gear and around which a part of a traction rope is wound, and is movable along the rope by rotating the sheave. The sheave is provided with a rope groove formed by a pair of side plates substantially along the entire circumference of the sheave for receiving a part of the rope therein and resiliently pressing the rope on its side portions. In one aspect of the invention, the rope traction device includes an improved brake system according to which slots elongated in the circumferential direction are formed in each clutch member and these slots have a larger width axially in the central portion thereof than in other portions. Rolling members such as steel balls are provided in the slots movably between the central portion and other portions of the slots so as to change the distance between the clutch members and thereby apply and release the brake.

3 Claims, 4 Drawing Sheets

ROPE TRACTION DEVICE

This is a divisional of application Ser. No. 07/373,904 filed June 29, 1989.

FIELD OF THE INVENTION

This invention relates to improvements in a rope traction device used for winding instruments for construction, loading and unloading and conveying machines including moving scaffolds, elevators and cranes. The invention is directed particularly to improvement in reliability and durability of the rope traction device.

BACKGROUND OF THE INVENTION

A rope traction device is a type of winding instrument used for construction, loading and unloading and conveying machines such as moving scaffolds, elevators and cranes and is capable of moving up and down along a rope with the rope wound around its sheave by only one or a few windings and without winding the rope around and feeding it from a drum.

An example of a prior art rope traction device used for moving up and down a moving scaffold for performing work along an exterior wall surface of a building is shown in FIGS. 3 and 4. This rope traction device includes a frame 1, a drive shaft 2 mounted on the frame 1, a motor 3 provided on the outer periphery of the drive shaft 2 through a bearing and a sheave 4 driven by this motor 3. The rope traction device further includes a traction mechanism 6 for holding a rope 5 wound about this sheave 4 by one winding for preventing the rope 5 from slipping off the sheave 4 and further a brake mechanism 7.

This traction mechanism 6 includes an L-shaped pivoting arm 8 provided in the vicinity of a point at which the rope 5 is disengaged from the sheave 4. A pair of rollers 9, 9 are rotatably mounted at one end of the pivoting arm 8 to press the rope 5 inwardly from a straightly tightened state thereof. Another pair of rollers 10, 10 are rotatably mounted on a pivoting arm 11 which is pivotably mounted at the other end of the pivoting arm 8.

According to this structure, as the rope 5 becomes straightly tightened, the rollers 9, 9 which are in contact with the rope 5 are pushed by the rope outwardly and the pivoting arm 8 thereby is pivoted in a counterclockwise direction to cause the rope 5 to be pressed by the rollers 10, 10 to the groove of the sheave 5.

The output shaft of the motor 3 is coupled to the drive shaft 2 and a wheel 14 of an intermediate shaft 13 is meshed with a pinion 12 provided on the drive shaft 2. A second pinion 15 of the intermediate shaft 13 is meshed with a gear 20 of a brake wheel 19 having a female screw 18 which is in threaded engagement with a male screw 17 of a driven shaft 16. A pinion 21 formed at the end portion of the driven shaft 16 is meshed with a ring gear 22 which is secured to the sheave 4 by means of bolts 28. A flange portion 23 is formed on the driven shaft 16 in a manner to oppose the brake wheel 19. Linings 24, 24 are provided on opposing surfaces of the flange portion 23 and the brake wheel 19. A brake disk 26 which can rotate in one direction only through the frame 1 and a ratchet 25 is provided between the flange portion 23 and the brake wheel 19.

When it is desired to elevate the rope traction device by rotating the sheave 4 clockwise as viewed in FIG. 4, the driven shaft 16 is rotated counterclockwise. Since the ratchet 25 is free in this direction, the brake wheel 19 whose female screw 18 is in threaded engagement with the male screw 17 of the driven shaft 16 is displaced to the left as viewed in FIG. 3 by the rotation of the brake wheel 19 to press the brake disk 26 against the flange portion 23. Thus, the brake wheel 19 is rotated integrally with the driven shaft 16 to transmit the drive force to the sheave 4.

When the sheave is rotated counterclockwise, i.e., a direction in which the rope traction device is lowered, the disk brake 26 is locked by the ratchet 25 and the sheave 4 itself is in a loaded state. By the rotation of the motor 3, the brake wheel 19 is rotated in a direction in which the brake wheel 19 is displaced to the right as viewed in FIG. 3 and the rope traction device is lowered due to the load applied to the sheave 4 by a distance corresponding to the gap produced in the disk brake 26. The rope traction device is lowered by repeating release and engagement of the brake 7.

In the traction mechanism 6 described in which the rope 5 is pressed against the sheave 4 by the pair of rollers 10, 10 mounted on the pivoting arm 11, bending a moment is repeatedly applied to the rope 5 at points of contact with the V-shaped groove of the sheave 4 at two positions at which the rollers 10, 10 press the rope 5. Besides, the rollers 10, 10 tend to slip sideways by force applied in the transverse direction by twisting of the rope 5. For these reasons, wear occurs in the rope 5 and the life of the rope 5 thereby is shortened.

Besides, as wear occurs in the rope 5 and its diameter thereby is reduced, the position of the pivoting arm 8 before pivoting is changed so that the pressing force, i.e., traction force, obtained by inward displacement of the rollers 9, 9 is changed with resulting instability in the traction force.

It is, therefore, an object of the invention to provide a rope traction device which is capable of producing a large rope pressing force and ensuring a prolonged life of the rope without causing wear in it.

In the brake mechanism 7 in which the braking force is produced by the screw mechanism between the brake wheel 19 and the driven shaft 16, the force produced by the screws 17 and 18 is weak when the load is relatively small. This gives rise to the problem that, when grease used for lubricating the component parts such as wheels located near the linings 24, 24 contaminates the linings 24, 24, the force produced by the screws 17 and 18 is too small to force the grease out of the linings 24, 24 with a result that the braking force is decreased.

There is another problem in the brake mechanism 7 such that, when a large force such as an impact force has been applied to the brake mechanism 7, there is the likelihood that the tightening force produced between the screws 17 and 18 becomes excessively large with resulting malfunction of the brake 7.

In the brake mechanism 7 in which release and application of the brake 7 are repeated frequently during lowering of the rope traction device, grease tends to be deteriorated due to heat of friction produced in the linings 24, 24 when the distance of downward movement of the rope traction device is long with a result that the linings 24, 24 tend to burn and the braking efficiency is seriously reduced.

It is, therefore, another object of the invention to provide a rope traction device capable of producing a stable braking force regardless of the magnitude of load applied to the brake mechanism.

SUMMARY OF THE INVENTION

In a rope traction device including a sheave which is rotated by a drive source through a speed reduction device and around which a part of a rope is wound, and being movable along the rope by rotating the sheave, the rope traction device achieving the first object of the invention comprises rope groove forming means provided substantially along the circumference of the sheave for forming a groove for receiving a part of the rope therein and resiliently pressing the part of the rope on its side portions, and guide rollers provided along the outer periphery of the rope groove forming means for guiding the rope along the groove.

According to the invention, the rope groove is made of means provided substantially along the circumference of the sheave and pressing the rope received therein at both its side portions so that the rope is pressed over substantially the entire circumference of the sheave and local generation of bending moment thereby is prevented. Therefore, wear in the rope can be held at the minimum so that the life of the rope can be prolonged and a stable traction force can be obtained.

In a preferred form, the rope groove forming means is made of a pair of plate springs of a generally annular configuration.

In one aspect of the invention, the pair of plate springs are each formed with a plurality of openings. The rope bulges into these openings whereby the rope holding force is increased.

In another aspect of the invention, the width of rollers among the guide rollers provided at end portions of the rope groove forming means is made slightly larger than the diameter of the rope. By this arrangement, feeding of the rope into and out of the rope groove is facilitated.

In still another aspect of the invention, the peripheral surface of the sheave which defines the bottom of the rope groove is formed with projections or depressions for increasing friction between the rope and the rope groove. By this arrangement, friction increases with a resulting increase in the rope traction force.

In a rope traction device including a sheave which is rotated by a drive source through a speed reduction device and around which a part of a rope is wound, and being movable along the rope by rotating the sheave, the rope traction device achieving the second object of the invention comprises clutch means comprising a first clutch member provided on an output shaft of the drive source and a second clutch member provided on an input shaft of the speed reduction device, each clutch member having a flange and engaging means provided on the flange for engaging the clutch members with each other, brake means provided axially slidably about the outer periphery of the first clutch member and having a braking flange portion disposed about the outer periphery of the flange of the first clutch member, said flange portion of the brake means opposing the flange of the second clutch member, brake urging means for urging the flange portion of the brake means axially toward the flange of the second clutch member, a brake disk provided between the braking flange portion of the brake means and the flange of the second clutch member, slots elongated in the circumferential direction in each of the clutch members of the clutch means, said slots having a larger width axially in the central portion thereof than in other portions thereof, and rolling members provided in the slots movably between the central portion and other portions thereof.

According to the invention, since the brake mechanism is constructed without employing a screw device and a ratchet and, besides, the brake mechanism is actuated only when the motor is not run, deterioration of grease or burning of brake linings due to heating of the brake portion and malfunction of the brake due to overtightening of the screws can be eliminated and a stable braking force can be ensured regardless of the magnitude of load applied to the brake.

BRIEF DESCRIPTION OF THE DRAWINGS

In the accompanying drawings.

DESCRIPTION OF A PREFERRED EMBODIMENT

Figure 1:
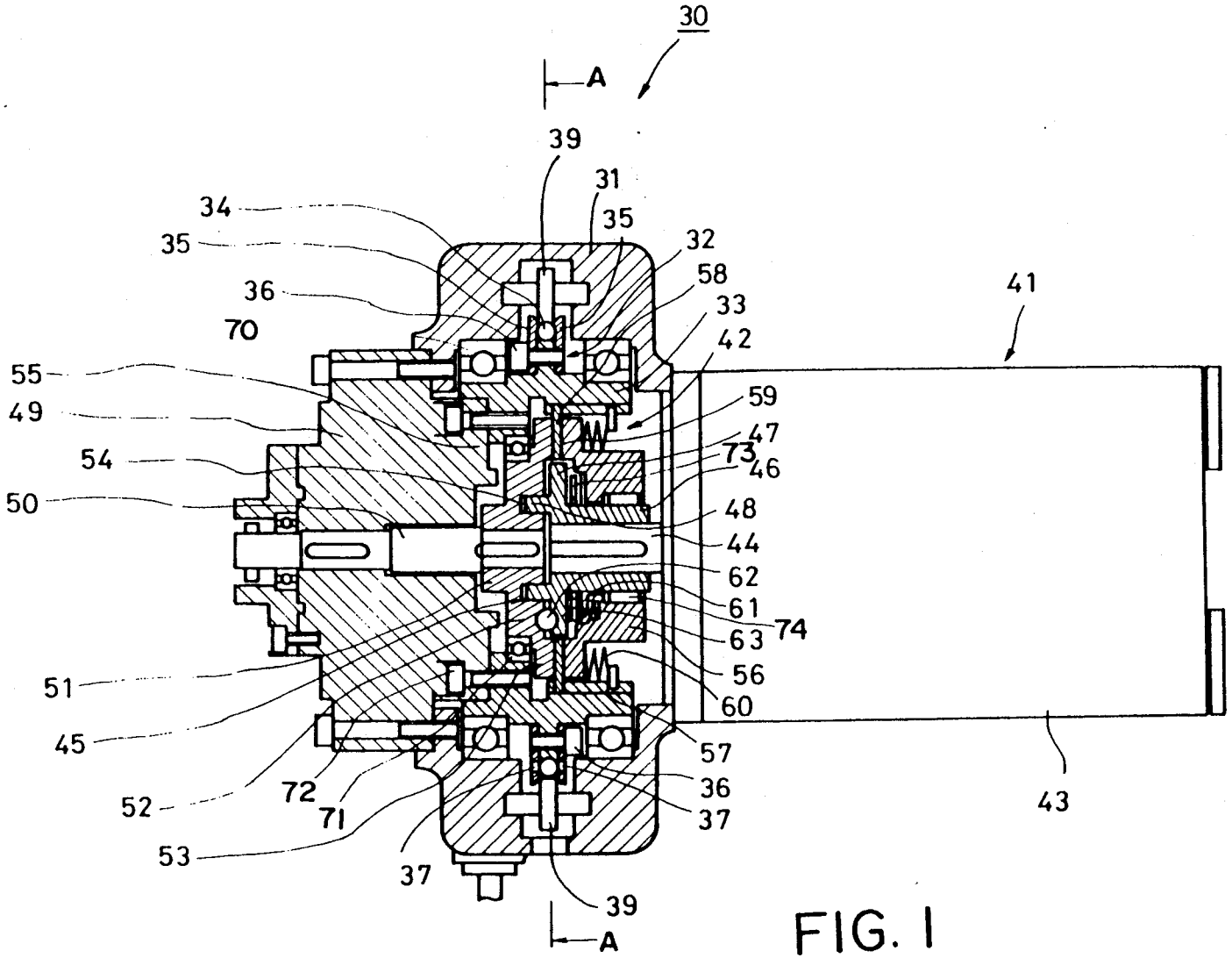
FIG. 1 is a vertical sectional view of a preferred embodiment of the rope traction device according to the invention.
Figure 2:
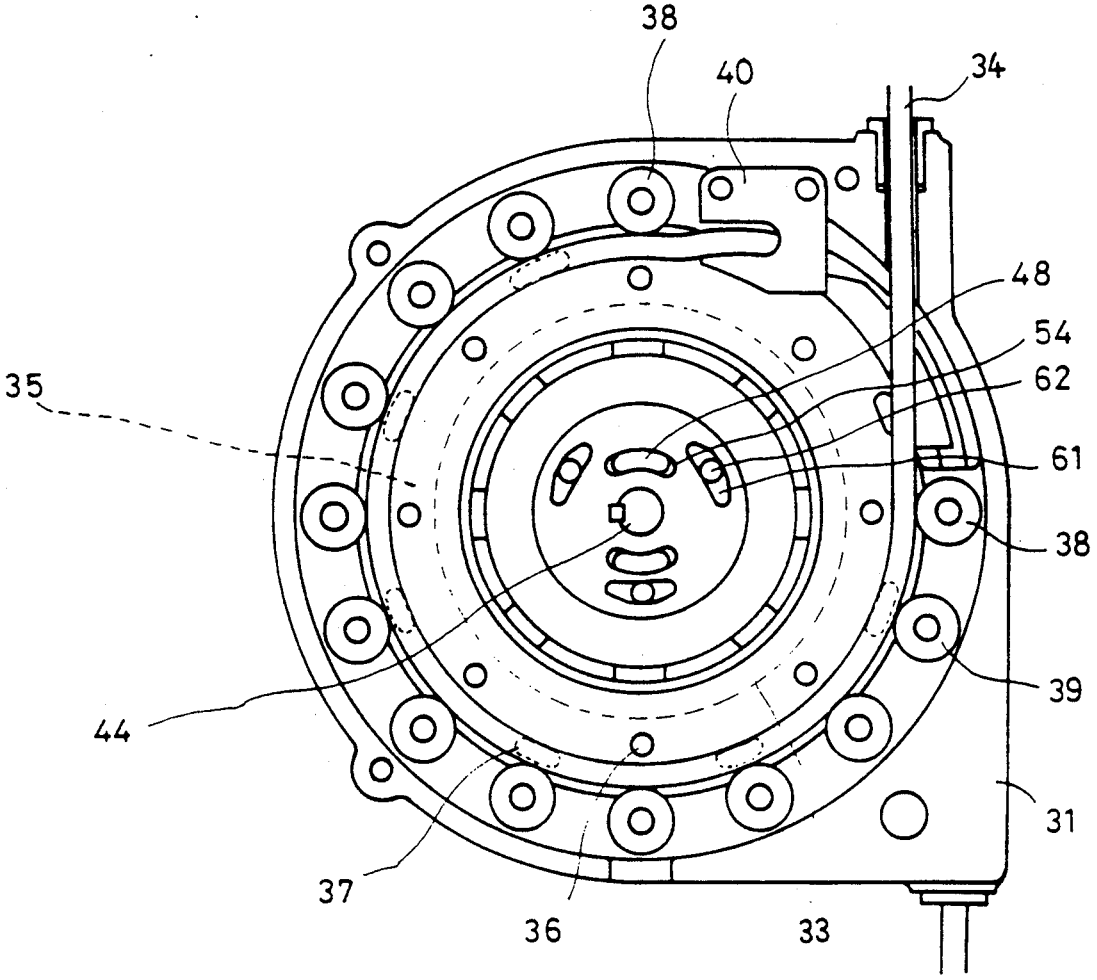
FIG. 2 is a sectional view thereof taken along lines A—A in FIG. 1.
Figure 3:
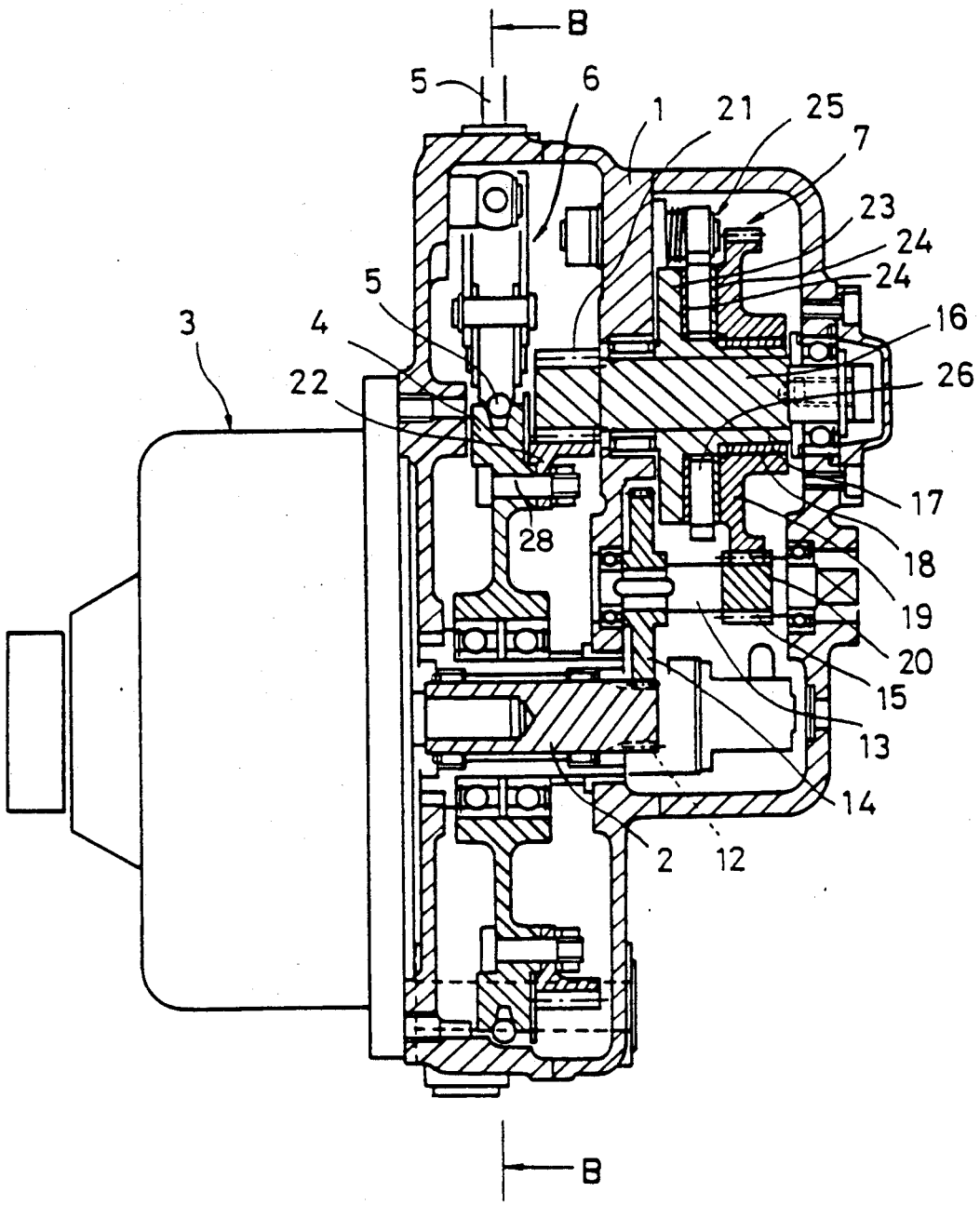
FIG. 3 PRIOR ART
FIG. 3 is a vertical sectional view of the prior art rope traction device.
Figure 4:
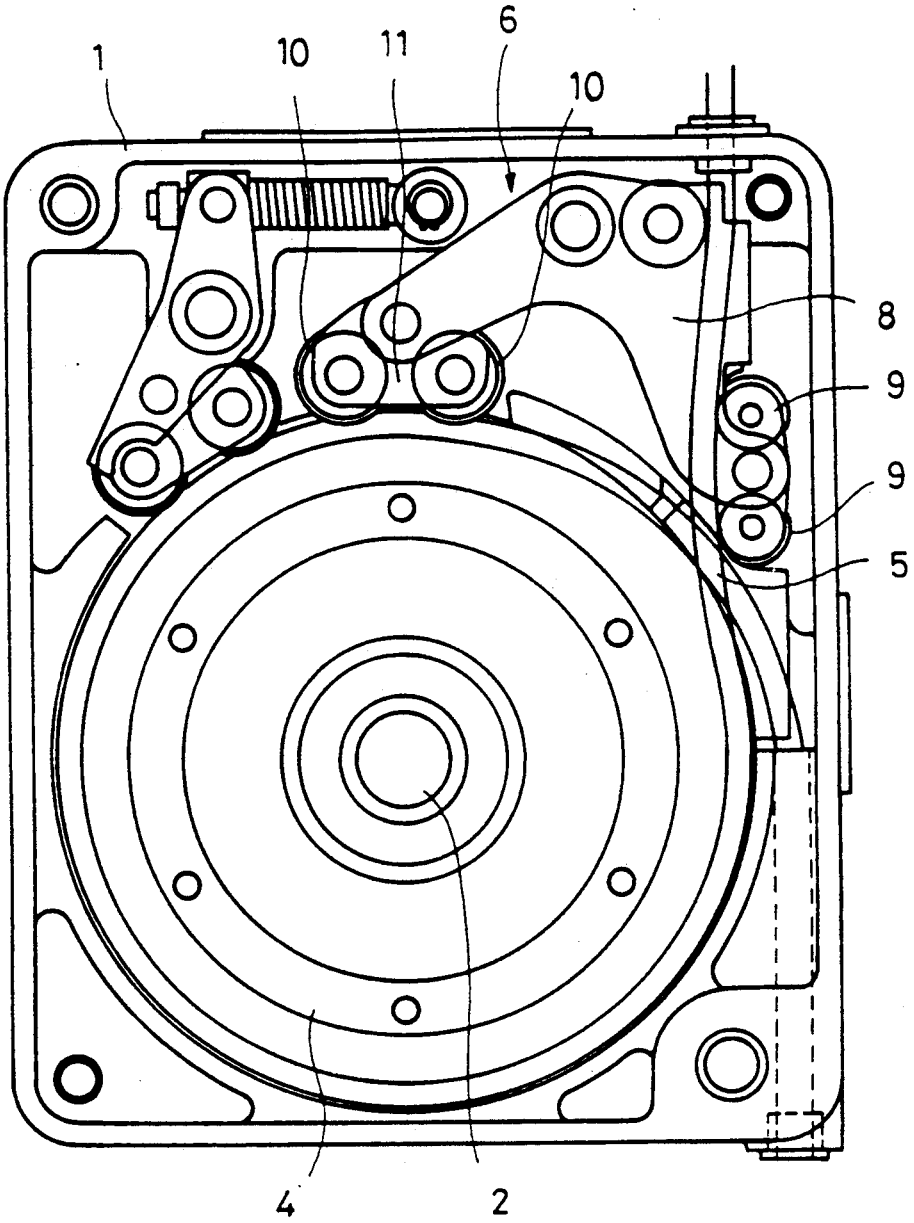
PRIOR ART FIG. 4
FIG. 4 is a sectional view thereof taken along lines B—B in FIG. 3.

Referring to FIGS. 1 and 2, an embodiment of the invention will now be described.

In this rope traction device 30, a sheave 32 mounted on a frame 31 is made of a sheave main body 33 and a pair of side plates 35, 35 mounted on both sides of the sheave main body 33 to form a rope groove for a traction rope 34.

The sheave main body 33 has a thickness in its outer peripheral portion which is slightly smaller than the diameter of the rope 34 and has its peripheral surface defining the bottom of the rope groove preferably formed with projections or depressions or both for increasing friction between the rope 34 and the rope groove. In the present embodiment, the peripheral surface of the sheave main body 33 is knurled. The sheave main body 33 is rotatably supported through ball bearings 70, 70 on the frame 31 in its peripheral surface portions outside of the portion defining the bottom of the rope groove.

The side plates 35, 35 secured to the sheave main body 33 which constitute the rope groove forming means are made of a pair of plate springs of a generally annular configuration and are provided substantially along the circumference of the sheave for forming a groove for receiving a part of the traction rope 34 therein and resiliently pressing the part of the rope on its side portions. The side plates 35, 35 are secured to the sheave main body 33 by means of bolts 36 on each side of the sheave main body 33. The side plates 35, 35 are formed in their portions which come into contact with the rope 34 with circumferentially elongated and circumferentially equidistant slots 37 for allowing the rope 34 clamped by the pair of side plates 35, 35 to bulge into these slots 37 and thereby increasing the traction force owing to a wedge action of the rope 34 pulled in this state.

For ensuring a smooth movement of the rope 34 through the rope groove of the sheave 32 thus formed, guide rollers 38 and 39 are equidistantly mounted on the frame 31 on the outer peripheral side of the sheave 32.

Except for the pair of guide rollers 38, 38 which are provided at the ends of the rope groove, the guide rollers 39 are disposed in such a manner that their outer peripheral portion existing between the side plates 35, 35 in a non-contacting state. The width of the guide rollers 38, 38 is made slightly larger than the diameter of the rope 34 so that the guide rollers 38, 38 pushes the side plates 35, 35 open to facilitate feeding of the rope 34 into and out of the rope groove.

A fixed type rope guide 40 is provided on sheave main body 33 in a portion outside of the guide roller 38 on the exit side of the rope 34 for facilitating feeding of the rope 34 out of the rope groove of the sheave 32.

A drive mechanism 41 for driving the sheave 32 and a brake mechanism 42 for applying brake to the sheave 32 will now be described.

As a drive source, a motor 43 with a DC brake is mounted on the frame 31. A clutch member 46 which constitutes a part of clutch means 45 is provided on an output shaft 44 of the motor 43 in a manner to transmit the drive force of the motor 43 and to be axially displaced. This clutch member 46 is formed in its foremost end portion with a flange 47 and projections 48 are formed integrally with the flange 47 for transmitting the drive force.

An input shaft 50 of a reduction gear 49 which is known per se is disposed coaxially with the output shaft 44 of the motor 43 and another clutch member 51 which constitutes a part of the clutch means 45 is mounted on the input shaft 50. This clutch member 51 is formed with a flange 52 which is of a larger diameter than the flange 47 of the clutch member 46 and a portion of the flange 52 which is extending radially outwardly of the outer periphery of the flange 47 constitutes a brake flange 53. The clutch member 51 is formed at locations opposite to the projections 48 of the flange 47 with arcuate clutch recesses 54 whose width is slightly larger than the diameter of the projections 48 and whose length is slightly larger than the length of the projections 48. Ball bearings 71, 71 are provided between the outer peripheral surface of the clutch member 51 and the inner peripheral surface of the sheave main body 33 so that the clutch member 51 is rotatably supported by the sheave main body 33.

An output portion 55 of the reduction gear 49 is connected integrally to the sheave main body 33 by means of bolts 72 so as to transmit the drive force of the motor 43 to the sheave 32 through the clutch means 45 and the cyclon reduction gear 49.

Description will be made about the brake mechanism 42. A brake member 56 is axially slidably mounted on the outer peripheral surface of the clutch member 46 on the side of the output shaft 44. The brake member 56 has a flange opposing the brake flange 53. Needle thrust bearings 73 are provided between the brake member 56 and the rear surface of the flange 47 of the clutch member 46 and needle bearings 74 are provided between the brake member 56 and outer peripheral surface of the clutch member 46. A brake disk 58 is provided between the brake member 56 and the brake flange 53 of the clutch member 51 in a manner to be axially slidable along a spline 57 formed on the inner peripheral surface of the sheave main body 33. Brake linings 59 are secured on both sides of the brake disk 58.

A spring 60 which constitutes the brake urging means is provided between the rear surface of the brake member 56 and the sheave main body 33 for urging the flange of the brake member 56 axially toward the brake flange 53 of the clutch member 51. Thus, brake is applied by clamping the brake disk 58 between the brake flange 53 and the brake member 56.

Figure 5:
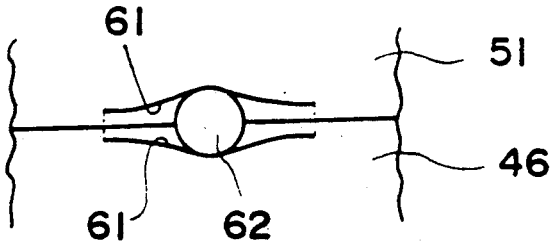
FIG. 5 is a cross sectional view of a slot formed in clutch members with a steel ball received therein.

For engaging and disengaging this brake mechanism, three slots 61 elongated in the circumferential direction are formed at equidistant interval in each of flanges 47 and 52 of the clutch members 46 and 51. These slots 61 each have a larger width axially in the central portion thereof than in other portions thereof as shown in FIG. 5. Steel balls 62 which constitute rolling means are provided in the slots 61 movably between the central portion thereof and the other portions thereof. The interval between the flanges 47 and 52 is changed depending upon the position of these steel balls 62 in the slots 61. Springs 63 are provided between the clutch member 46 and the brake member 56 so as to prevent the steel balls 62 from being disengaged from the slots 61 when the interval between the flanges 47 and 52 becomes large.

The operation of the rope traction device 30 will now be described.

When the rope traction device 30 is to be lifted along the rope 34, the motor 43 is driven in a direction in which the rope 34 is wound thereby to rotate the sheave 32 clockwise as viewed in FIG. 2 whereas when the rope traction device 30 is to be lowered along the rope 34, the motor 43 is driven in a direction in which the rope 34 is rewound thereby to rotate the sheave 32 counterclockwise as viewed in FIG. 2.

In either case, the rotational force of the motor 43 is transmitted from the output shaft 44 to the clutch member 46 and further to the other clutch member 51 through the projections 48 and the recesses 54.

In a state where the motor 43 is not running, the steel balls 62 are positioned in the central portion of the slots 61 having the largest width and, accordingly, the brake linings 59 of the brake disk 58 are clampled between the brake member 56 and the brake flange 53 and the sheave 32 and the output shaft 44 of the motor 43 is connected rigidly to each other through the cyclon reduction gear 49 having a large speed reduction ratio so that a state where the brake is engaged is brought about.

If the motor 43 is rotated from this state, the clutch member 46 coupled to the output shaft 44 is rotated and the slots 61 formed in the flange 47 of the clutch member 46 are thereby rotated. This causes the steel balls 62 to move relatively in the slots 61 from the central portions to a corner of the slots 61 and the clutch member 46 is pushed back by the steel balls 62. This in turn causes the brake member 56 to be pushed back by the clutch member 46 through the spring 60 whereby the brake is disengaged and the drive force is transmitted to the other clutch member 51 to rotate the sheave 32.

Thus, according to the rope traction device 30, the brake is disengaged during lifting or lowering of the rope traction device 30 and engaged only during stoppage of the motor 43.

In the sheave 32, the rope 34 which is wound about the sheave 32 by about one winding is located in the rope groove formed by the side plates 35, 35, guided by the guide rollers 38 and 39. The drive force is transmitted to the rope 34 which is clamped by the side plates 35, 35 substantially along its entire circumference.

Since slots 37 are formed in the side plates 35, 35, the clamped rope 34 bulges into the slots 37 and a wedge action is produced between the slots 37 and the rope 34 by pulling of the rope 34 in this state so that efficiency of transmission of the power from the sheave 32 to the rope 34 is increased.

Since the peripheral surface of the sheave which defines the bottom of the rope groove is knurled, friction between the sheave 32 and the rope 34 increases with resulting increase in the traction force.

As described, lifting and lowering of the rope traction device 30 along the rope 34 is made under condition that the steel balls 62 are positioned in a portion of the slots 61 in which the axial width of the slots 62 is smaller and the brake thereby is disengaged. When there arises a difference in the ratio of the number of revolutions between the sheave 32 which is on the load side and the motor 43, e.g., when load is large during lowering with a result that the revolution number of the sheave 32 tends to become larger than normal, there arises a difference in the number of revolutions number between the clutch members 46 and 51.

In this case, the steel balls 62 move toward the central portion of the slots 61 where the axial width is the largest so that the clutch member 46 and the brake member 51 are pushed by the spring 60 to the left as viewed in FIG. 1 to cause the brake disk 58 to be clamped between the brake flange 53 and the brake member 56 and thereupon the brake starts to be engaged to decrease the speed of lowering of the sheave 32.

In the rope traction device 30 in which the drive force is transmitted by using the side plates 35, 35 made of plate springs, the rope is pressed uniformly substantially over its entire circumference so that a greater traction force can be obtained than in the prior art device in which tractoin force is obtained by pressing the rope with the pair of rollers. Besides, wear or breaking of the rope due to a concentrated load is reduced so that the life of the rope can be prolonged.

If the diameter of the rope 34 has changed, change in the traction force can be minimized since the rope is clamped on both sides thereof by the side plates 35, 35 along its entire circumference. Thus, a stable traction force can be obtained and reliability of the device is improved.

According to the invention, wearing of the rope groove can be coped with simply by replacing the side plates 35, 35.

When a heavy load such as impact force has acted upon the rope 34, the effect of such load can be mitigated by slipping of the rope 34 in the rope groove of the sheave 32 and damage to the mechanical parts such as the motor 43 can be prevented.

Since the brake is applied only during stoppage of the motor and the brake is disengaged during lifting and lowering of the rope traction device 30, generation of heat of friction in the brake linings 59 can be minimized even in a case where distance of liftng or lowering is large so that deterioration of grease or burning or wear of the linings can be effectively prevented.

Since the ratchet mechanism as in the prior art is not employed in the present invention, generation of noise is held to a minimum. Further, since the screw device is not employed for applying the brake as in the prior art device, malfunction due to overtightening of the screw will not occur and overload can be mitigated.

The rope traction device according to the invention can be used for not only a winder for a moving scaffold but a winder for various other construction, loading and unloading and conveying machines.

The brake disk is not limited to one but a plurality of brake disks and brake members may be used to compose a multi-plate type brake for increasing the brake force.

As the traction rope, a wire rope is preferable but other types of rope may be used as well depending upon load condition.

What is claimed is:

1. A rope traction device including a sheave which is rotated by a drive source through a speed reduction device and around which a part of a rope is wound, and being movable along the rope by rotating the sheave, and a rope traction means comprising:

clutch means comprising a first clutch member provided on an output shaft of the drive source and a second clutch member provided on an input shaft of the speed reduction device, each clutch member having a flange and engaging means provided on the flange for engaging the first and second clutch members with each other;

brake means provided axially slidably about the first clutch member and having a braking flange portion disposed about the flange of the first clutch member, said braking flange portion of the brake means opposing the flange of the second clutch member;

brake urging means for urging the braking flange portion of the brake means axially toward the flange of the second clutch member;

a brake disk provided between the braking flange portion of the brake means and the flange of the second clutch member;

slots elongated in the circumferential direction in each of the first and second clutch members, said slots having a central portion and a peripheral portion, said central portion having a larger width axially than the width of the peripheral portion; and rolling members provided in the slots movably between the central portion and the peripheral portion.

2. A rope traction device as defined in claim 1 wherein the engaging means for engaging the first and second clutch members to each other comprise a projection formed in one of the clutch members and a recess formed in the other of said clutch members.

3. A rope traction device as defined in claim 2 wherein the rolling members are steel balls.

* * * * *